United States Patent [19]

Seitzer

[11] 4,048,029

[45] Sept. 13, 1977

[54] MANUFACTURE OF HYDROGEN

[75] Inventor: Walter H. Seitzer, West Chester, Pa.

[73] Assignee: Suntech, Inc., St. Davids, Pa.

[21] Appl. No.: 701,828

[22] Filed: July 1, 1976

[51] Int. Cl.$^2$ ..... C25B 1/02

[52] U.S. Cl. ..... 204/129

[58] Field of Search ..... 204/129, 295; 429/33

[56] References Cited

U.S. PATENT DOCUMENTS

| | | | |
|---|---|---|---|
| 3,616,334 | 10/1971 | Aker et al. | 204/129 |
| 3,993,653 | 11/1976 | Blum et al. | 204/129 |

OTHER PUBLICATIONS

"The Gezro Process for Open-Cycle $H_2$ Production" by KW Browall et al., A.C.S. Preprints, Fuel Div., vol. 20, No. 2, Apr. 6-11, 1975.

*Primary Examiner*—R. L. Andrews

*Attorney, Agent, or Firm*—J. Edward Hess; Donald R. Johnson; Paul Lipsitz

[57] ABSTRACT

In the process of preparing hydrogen by passing a gas containing carbon monoxide over one side of a membrane which transports ionic oxygen and by passing steam over the other side of said membrane whereby the steam is converted to hydrogen and the carbon monoxide is oxidized to carbon dioxide, the improvement which comprises employing as said membrane a metal salt where the metal cation is selected from metals of Groups IB, IIB, and VA, and the salt anion is an oxygen containing anion of a metal from Group VB, VIB, and VIIB.

10 Claims, No Drawings

MANUFACTURE OF HYDROGEN

It is known in the art to prepare hydrogen from steam using an open cycle technique using a ceramic membrane that is both an electron conductor and an oxygen ion conductor. Such a system is disclosed by K. W. Browall and R. E. Hanneman, Preprints, Fuel Div. A.C.S., Vol. 20, No. 2, April, 1975. In the technique of these authors steam is passed over one side of a membrane while carbon monoxide is passed over the opposite side of the membrane. On the "cathode" side, the steam reacts at the surface with two electrons to yield hydrogen gas plus an oxygen ion, which is transported through the electrolyte to combine at the "anode" surface with carbon monoxide to form carbon dioxide plus two electrons. This process, operating without electrical input, has been named GEZRO.

The membrane of the GEZRO process has heretofore been a doped zirconium oxide. Thus, the above paper discloses that the membrane may be prepared by the addition of a cation in the +2 or +3 oxidation state to zirconium oxide and suggests $Y_2O_3$ as particularly useful. The above authors also disclose that while it is theoretically possible to carry out the process at 800° C for 80% oxidation of CO to $CO_2$ while converting half the input steam to hydrogen, in general, the operating temperature will be between 700° C. and 1000° C. at any required pressure.

The process of the present invention provides a significant improvement over the above described GEZRO process and provides a relatively simple and low cost means for obtaining hydrogen, particularly from those gases obtained with the mixture obtained from carbonaceous fuels. In accord with the invention hydrogen is obtained by passing at elevated temperature, a carbon monoxide containing gas over one side of a membrane which transports ionic oxygen and by passing steam over the other side of said membrane whereby hydrogen is generated from said steam and carbon monoxide is converted to carbon dioxide, said membrane being a metal salt where the metal cation is a metal from Groups IB, IIB, and VA, and the salt anion is an oxygen containing anion of a metal from Group VB, VIB and VIIB.

In order to more fully describe the invention reference is now made to the following description. Chambers A and B are separated by a membrane M which transports oxygen ions (e.g. $O^=$). The input to chamber A is a mixture of gases containing carbon monoxide, such gases typically being obtained from the combustion of carbonaceous fuels. Steam is introduced to Chamber B, preferably in a counter-current direction. Under the conditions of the process, the steam is decomposed to hydrogen and oxygen ions and the ionic oxygen by means of membrane transport combine with the carbon monoxide in Chamber A to form $CO_2$. The reactions involved are:

$$\text{Chamber A: } CO + O^= \rightarrow CO_2 + 2e^-$$

$$\text{Chamber B: } H_2O + 2e \rightarrow H_2 + O^-$$

By adding the above reactions it is apparent that the effective reaction is:

$$H_2O + CO \rightarrow H_2 + CO_2$$

which is the shift reaction, but the effective end result of the process is the obtaining of hydrogen from the steam entering Chamber A.

The conditions under which the process takes place depend on the cell design and properties of the particular membrane. However, the membranes used in this invention are operative at temperatures in the region of 500°-650° C. and thus enable operation of the process at significantly lower temperatures than that of the prior art.

The membranes M used in the invention are, as indicated, salts of a metal from Groups I, II and VIII and an oxygen containing anion of a metal of Group VB, VIB and VIIB. Thus, the oxygen containing anions are exemplified by vanadates, chromates, molybdates, tungstates, manganates, and the like. The cation metal, as indicated, is one from Groups IB (preferably silver), IIB (preferably zinc), and VA (preferably bismuth). Particularly useful membranes will be those made of bismuth molybdate, silver molybdate, zinc molybdate. The membrane materials are known compounds and may be purchased or prepared by reacting mixtures of the metal oxides above the melting temperature. The membrane composition is comprised of a porous support such as alumina, magnesia, sintered metals, etc., on which the membrane material is deposited by conventional impregnation techniques.

As indicated, the carbon monoxide containing gas is preferably obtained from combustion of a carbonaceous fuel such as coal, heavy petroleum fractions and the like. In such reactions, the first step is a gasification where fuel, oxygen (air) and steam react to from a mixture of mainly of CO, $H_2$, and $CO_2$. To make pure hydrogen such gas must be purified, the CO shifted with steam to $H_2$ and $CO_2$ and then the $CO_2$ scrubbed out. Such a series of steps is expensive and the capital investment for such a plant is high. For these reasons, the process of the invention as described above is particularly valuable and permits, in effect, the highly efficient preparation of hydrogen from steam by use of the oxygen transport membrane as described. It will be understood that when a carbon monoxide gas also contains hydrogen, as is the case with those gases obtained from carbonaceous fuels, the hydrogen will also react with the ionic oxygen to form water and will act as a driving force to aid in high conversion of steam to hydrogen at the "cathode" reaction side of the membrane.

In order to further describe the invention the following examples are given:

EXAMPLE 1

A porous alundum extraction thimble is impregnated and coated with bismuth molybdate by placing the bismuth molybdate in a thimble, heating thimble and its contents at about 650° C. in an electric furnace to obtain a melt and manipulating the thimble with tongs until the entire inside area is impregnated with the melt, after which, excess molten bismuth molybdate is poured out of the thimble. The impregnated thimble is then reduced in a flowing hydrogen atmosphere at 480° to 500° C. The coated thimble is tested for leaks by stoppering it concentrically in a large test tube and through input and output tubes flowing CO over the inner surface of the thimble and flowing air over the outer surface. Analysis of the exiting air stream for CO or of the exiting CO stream for nitrogen indicates a leak if such analysis is positive. If a leak is found, the impregnation procedure is repeated until no leak is found.

The conductivity of the impregnated thimble membrane for oxide ions is carried out by placing the concentric thimbletest tube apparatus in a furnace at elevated temperature and passing carbon monoxide over the inner surface of the thimble and air over the outer surface while analyzing the exit CO stream by gas chromatography. The following table indicates the results:

| Temp. ° C | % $CO_2$ in CO Stream | % $N_2$ in CO Stream |
|---|---|---|
| 480 | NONE | NONE |
| 540 | 4 | NONE |
| 590 | 22 | NONE |

It is evident from the above that the ionized oxygen of the air passes through the membrane to effect oxidation of CO to $CO_2$ at temperatures about 500° C. but no nitrogen passes through.

EXAMPLE 2

In a manner similar to Example 1 two alundum thimbles are impregnated, one with silver molybdate and the other with zinc molybdate. Tests for oxide conductivity are carried out as in Example 1 with the following results:

| | Temp. ° C | % $CO_2$ in CO Stream | % $N_2$ in CO Stream |
|---|---|---|---|
| Silver Molybdate | 370 | NONE | NONE |
| | 440 | NONE | NONE |
| | 480 | Small Amt. | NONE |
| Zinc Molybdate | 488 | 4 | NONE |
| | 549 | 4 | NONE |
| | 604 | 14 | NONE |

It is clear from the above that while the membranes do permit movement of ionic oxygen at relatively low temperature, (i.e., below about 500° C.), the preferred temperature for efficient operation is about about 500° C. and most preferably at about 600° C. to about 650° C.

EXAMPLE 3

A flat porous alundum plate is impregnated with bismuth molybdate until it is found to be leak proof. It is then used as a central membrane of a standard design cell, the cell having inlets and outlets for each of its two side compartments. The cell is heated to 600° C. and into one side of the cell is flowed a 1:1:1 by volume mixture of CO, $H_2$ and $N_2$. Steam is flowed countercurrently through the other side compartment. After drying the effluent from the gaseous mixture it is analyzed by a gas chromatograph with the following results:

| | Gas Input (% by Vol.) | Gas Output (% by vol.) |
|---|---|---|
| $H_2O$ | NONE | 8 |
| $N_2$ | 33 | 33 |
| $H_2$ | 33 | 26 |
| CO | 33 | 19 |
| $CO_2$ | NONE | 15 |

The effluent from the steam side of the cell is condensed to remove water, leaving a gas which is essentially pure hydrogen in a yield of 0.24 liters per liter of starting mixture. This is equivalent to 36% conversion of the steam stream to hydrogen. It is clear from this data that the membrane transports ionic oxygen and thus enables the production of hydrogen by the thermal decomposition of steam and removal of oxygen through the membrane from the mixture of steam, hydrogen and oxygen so as to obtain a hydrogen-steam mixture from which essentially pure hydrogen is readily separated.

It will be understood that reducing the flow rate will increase the hydrogen yield as will raising the temperature. In a commercial operation very high hydrogen production by the method of this invention may be obtained by using a series of cells with the gases flowing countercurrently.

The invention claimed is:

1. In the process of preparing hydrogen by passing a gas containing carbon monoxide over one side of a membrane which transports ionic oxygen and by passing steam over the other side of said membrane whereby the steam is converted to hydrogen and the carbon monoxide is oxidized to carbon dioxide, the improvement which comprises employing as said membrane a metal salt where the metal cation is selected from metals of Group IB, IIB, and VA, and the salt anion is an oxygen containing anion of a metal from Groups VB, VIB, and VIIB.

2. The process of claim 1 operated at a temperature of from about 500° to about 650° C.

3. The process of claim 2 where the membrane is bismuth molybdate.

4. The process of claim 2 where the membrane is silver molybdate.

5. The process of claim 2 where the membrane is zinc molybdate.

6. The process of claim 1 where hydrogen is present in the carbon monoxide gas.

7. In the process of preparing hydrogen by passing a gas containing carbon monoxide derived by burning a carbonaceous fuel over one side of a membrane which transports ionic oxygen and by passing steam over the other side of said membrane whereby the steam is converted to hydrogen and the carbon monoxide is oxidized to carbon dioxide, the improvement which comprises employing as said membrane a porous support impregnated with metal salt where the metal cation is selected from metals of Groups IB, IIB, and VA, and the salt anion is an oxygen containing anion of a metal from Groups VB, VIB, and VIIB.

8. The process of claim 7 where the membrane is a molybdate of silver, zinc or bismuth.

9. The process of claim 7 where the membrane is a vanadate.

10. The process of claim 7 where the membrane is a tungstate.

* * * * *